US007163500B2

(12) United States Patent
Endelman et al.

(10) Patent No.: US 7,163,500 B2
(45) Date of Patent: Jan. 16, 2007

(54) REFORMER EXERCISE APPARATUS ANCHOR BAR ASSEMBLY

(75) Inventors: Ken Endelman, Sacramento, CA (US); Brian Janowski, Marquette, MI (US)

(73) Assignee: Balanced Body, Inc., Sacramento, CA (US)

( * ) Notice: Subject to any disclaimer, the term of this patent is extended or adjusted under 35 U.S.C. 154(b) by 18 days.

(21) Appl. No.: 10/723,407

(22) Filed: Nov. 25, 2003

(65) Prior Publication Data

US 2005/0113226 A1 May 26, 2005

(51) Int. Cl.
*A63B 26/00* (2006.01)

(52) U.S. Cl. ..... 482/142; 482/139

(58) Field of Classification Search ..... 482/142, 482/139, 121–130, 133–135, 908; D21/665, D21/676, 686, 690
See application file for complete search history.

(56) References Cited

U.S. PATENT DOCUMENTS

| | | | | |
|---|---|---|---|---|
| 339,638 | A | 4/1886 | Goldie | |
| 1,621,477 | A | 3/1927 | Pilates | |
| 1,738,987 | A | 12/1929 | Dattilo | |
| 1,750,549 | A | 3/1930 | Thomson et al. | |
| 1,979,783 | A | 11/1934 | Williams et al. | |
| 1,980,036 | A | 11/1934 | Casler et al. | |
| 2,733,922 | A | 2/1956 | Diego | |
| 3,261,606 | A | 7/1966 | Elia et al. | |
| 3,586,322 | A | 6/1971 | Kvemeland | |
| 3,770,267 | A | 11/1973 | McCarthy | |
| 3,892,404 | A | 7/1975 | Martucci | |
| 4,084,815 | A | 4/1978 | Flannery | |
| 4,272,074 | A | 6/1981 | Sferele | |
| 4,290,600 | A | 9/1981 | Kolbel | 272/137 |
| 4,357,010 | A | 11/1982 | Telle | 272/117 |
| 4,376,533 | A | 3/1983 | Kolbel | 272/137 |
| 4,383,684 | A | 5/1983 | Schliep | |
| 4,517,966 | A | 5/1985 | von Othegraven | 128/75 |
| 4,700,945 | A | 10/1987 | Rader | |
| 4,706,953 | A | 11/1987 | Graham | |
| 4,709,918 | A | 12/1987 | Grinblat | 272/97 |
| 4,768,776 | A | 9/1988 | Giannotti | |

(Continued)

FOREIGN PATENT DOCUMENTS

| | | |
|---|---|---|
| FR | 1470421 | 1/1967 |

(Continued)

*Primary Examiner*—Lori Amerson
(74) *Attorney, Agent, or Firm*—John R. Wahl; Greenberg Traurig, LLP

(57) ABSTRACT

A reformer exercise apparatus has a generally rectangular frame having a head end and a foot end and including a pair of spaced apart parallel track members, a movable carriage mounted on the frame for movement along the track members between said head and foot ends against one or more springs connected between the carriage and the foot end of the frame and an elastic member anchor bar and carriage stop assembly to adjustably position the carriage and elastic members on the tracks to accommodate a wide range of user heights. The anchor bar and carriage stop assembly includes an anchor bar having each end disposed in an elongated slot formed in each track member. The elongated slot has spaced gear teeth defining spaced anchor bar stop or lock portions. The anchor bar can be moved between lock portions only when rotated to an unlocked position wherein the bar can operably slide along the slot.

6 Claims, 8 Drawing Sheets

U.S. PATENT DOCUMENTS

| | | | | |
|---|---|---|---|---|
| 4,775,150 | A | 10/1988 | Graham | 272/143 |
| 4,776,583 | A | 10/1988 | Jennings | 272/73 |
| 4,884,802 | A | 12/1989 | Graham | |
| 4,911,438 | A | 3/1990 | Van Straaten | |
| 4,974,832 | A | 12/1990 | Dalebout | |
| 5,014,966 | A | 5/1991 | Wang | 267/64 |
| 5,024,214 | A | 6/1991 | Hayes | |
| 5,066,005 | A | 11/1991 | Luecke | |
| 5,207,628 | A | 5/1993 | Graham | 482/140 |
| 5,263,913 | A | 11/1993 | Boren | |
| 5,338,278 | A | 8/1994 | Endelman | |
| 5,352,169 | A | 10/1994 | Eschenbach | 482/57 |
| 5,364,327 | A | 11/1994 | Graham | |
| D354,780 | S | 1/1995 | Endelman | |
| D354,781 | S | 1/1995 | Endelman | |
| 5,423,729 | A | 6/1995 | Eschenbach | 482/70 |
| D362,700 | S | 9/1995 | Breibart et al. | |
| 5,529,554 | A | 6/1996 | Eschenbach | 482/57 |
| 5,580,340 | A | 12/1996 | Yu | 482/96 |
| 5,607,381 | A | 3/1997 | Endelman | |
| 5,653,670 | A | 8/1997 | Endelman | |
| 5,681,249 | A | 10/1997 | Endelman | |
| 5,792,033 | A | 8/1998 | Merrithew | 482/96 |
| 5,795,271 | A | 8/1998 | Pearson | 482/72 |
| 5,807,217 | A | 9/1998 | Endelman | |
| 5,816,981 | A | 10/1998 | Hung | 482/54 |
| 5,853,357 | A | 12/1998 | Jones, Jr. | 482/140 |
| 6,120,425 | A * | 9/2000 | Endelman | 482/142 |
| 6,179,759 | B1 | 1/2001 | Tellone | 482/111 |
| 6,186,929 | B1 | 2/2001 | Endelman et al. | 482/121 |
| 6,206,530 | B1 | 3/2001 | Eberts | 359/879 |
| 6,338,704 | B1 * | 1/2002 | Endelman | 482/142 |
| 2003/0119636 | A1 | 6/2003 | Endelman | |
| 2003/0195095 | A1 * | 10/2003 | Endelman et al. | |
| 2004/0022577 | A1 * | 2/2004 | Liao | |

FOREIGN PATENT DOCUMENTS

| | | |
|---|---|---|
| FR | 2 481 125 | 4/1980 |
| FR | 2625907 | 7/1989 |
| WO | WO 86/01735 | 3/1986 |

* cited by examiner

REFORMER EXERCISE APPARATUS ANCHOR BAR ASSEMBLY

BACKGROUND OF THE INVENTION

1. Field of the Invention

This invention relates generally to the field of exercise equipment in which a movable carriage is utilized to at least partially support a user's body, commonly referred to as a "reformer", and more particularly to a reformer having an adjustable spring anchor bar and carriage stop assembly.

2. Description of the Related Art

Joseph H. Pilates, in U.S. Pat. No. 1,621,477, originally developed the concept of using a wheeled platform carriage connected to a resistance device such as a set of weights in conjunction with a stationary frame to provide a variable resistance against which a user could push with his/her feet or pull with the arms while in a sitting or recumbent position in order to exercise the major muscle groups of the user's trunk, legs and/or arms. Since that time many changes and improvements in the design of such an apparatus were developed by Joseph Pilates, and more recently, have been evolved by his students and others. U.S. Pat. No. 5,066,005 and my patents referred to above are representative of the current state of evolutionary development of these changes that have taken place since 1927.

The current conventional apparatus is commonly referred to as a "reformer" which includes a wheeled platform carriage which rides on a parallel rails on or forming part of a rectangular wooden or metal frame. The carriage is connected to a series of parallel springs or elastic members which are in turn connected to a foot end of the rectangular frame. The carriage rides on parallel rails or tracks mounted to the inside of the longer sides of the rectangular frame. This carriage typically includes a pair of spaced, padded, upright shoulder stops and a head rest at one end to support the shoulders and head of the user when he/she is reclined on the carriage. An adjustable foot bar, foot support, or foot rest against which the user places his/her feet is removably mounted to the foot end of the rectangular frame. A spring support rod is positioned across the foot end between the tracks by a spring support bracket fastened to the frame. The rod typically fits in one of three or four recesses or slots in the support bracket, depending on the size or ability of the user. Alternatively, the spring support rod may be permanently fastened to the frame. The user can then push against the foot rest to move the carriage along the track away from the foot rest against spring tension to exercise the leg and foot muscle groups in accordance with prescribed movement routines. The carriage is prevented from moving close to the foot rest by a stop pin fastened to the top of each track, against which the carriage abuts when the carriage is at rest. Alternatively, the stop pin function may be performed by a spring anchor bar and carriage stop member such as is disclosed in my U.S. Pat. Nos. 6,120,425 and 6,338,704.

Many conventional reformer designs utilize a tubular anchor bar that slips into slanted slots in a bracket fastened to the rails at the foot end of the frame. The slots permit a user to adjust the longitudinal position of the anchor along the rails. This anchor bar is typically round in cross section. Thus, when a user decides to change the number of springs attached to the anchor bar, he or she must be careful not to remove all of the springs from the anchor bar at the same time, because without some spring tension on at least one hook, the anchor bar will simply rotate downward, positioning the hooks toward the floor. Then the user must use one hand to rotate the bar so that the hooks face the carriage, and use her other hand to fasten a spring onto one of the hooks. Another drawback with the conventional round bar and slotted bracket spring anchor design is that the brackets are separate components which must typically be installed at the foot end of the frame over the rails.

SUMMARY OF THE INVENTION

An embodiment of the present invention may be viewed as a reformer exercise apparatus that preferably includes a wheeled carriage having a generally flat top surface. The carriage is movably mounted on parallel track members attached to or forming sides of a generally rectangular frame which has a head end and a foot end. The carriage has a pair of shoulder stops mounted thereto and a head rest between the shoulder stops that extends outward from the carriage toward the head end of the frame. A plurality of elastic members connected between the foot end and the carriage elastically bias the carriage toward the foot end of the frame. A movable spring anchor bar and carriage stop assembly is incorporated into and between the track members at or adjacent the foot end of the rectangular frame to anchor the elastic members and position the carriage appropriately in relation to the anchor bar.

The track members are preferably tubes, each having preferably a rectangular cross section, that extend between the head end and the foot end of the frame. Alternatively, each of the track members could have a "top hat" or U shaped cross section such that, when fastened to the inside of the sides of the frame, the track has a horizontal track surface for the carriage support rollers and a vertical side wall for the carriage guide rollers to ride against. The spring anchor bar and carriage stop assembly in accordance with an embodiment of the present invention comprises the tubular track members and an elongated anchor bar having opposite ends that ride in elongated slots in facing vertical side walls of the tubular track members. More specifically, each track member has an elongated keyway slot formed adjacent the foot end of the track member in the inside wall of the track member. Each keyway slot has a series of spaced gear teeth that form spaced anchor bar stop portions. Each end of the anchor bar forms a key or tenon that rides within one of the elongated keyways such that the anchor bar is carried by and captured between the spaced apart track members by the keyed ends of the anchor bar.

When the anchor bar is captured in these slots, the anchor bar may be rotated about its longitudinal axis between a locked position against a set of the teeth and an unlocked position. These teeth or stop portions are shaped to permit rotation of the keyed end of the anchor bar between the locked and unlocked positions when both ends are aligned in corresponding stop portions. Between these stop portions, i.e., when the keyed ends are aligned parallel to the length of the elongated keyway slots, the anchor bar keyed ends slide so that a user can move the anchor bar back and forth toward and away from the foot end of the frame between the sequential stop portions of the keyways.

Another embodiment of the present invention is a reformer exercise apparatus in which the footbar may be positioned at either the head end or the foot end of the frame as well as various points in between via a support bracket assembly which slides in a T-slot along each of the frame sides and includes both horizontal and vertical foot bar positions along with various angular positions permitting the foot bar to be selectively positioned in a plurality of vertical positions from the carriage and near either the head or the foot end of the frame.

Other objects, features and advantages of the present invention will become apparent from a reading of the following detailed description when taken in conjunction with the accompanying drawing wherein a particular embodiment of the invention is disclosed as an illustrative example.

DETAILED DESCRIPTION OF THE INVENTION

Figure 1:
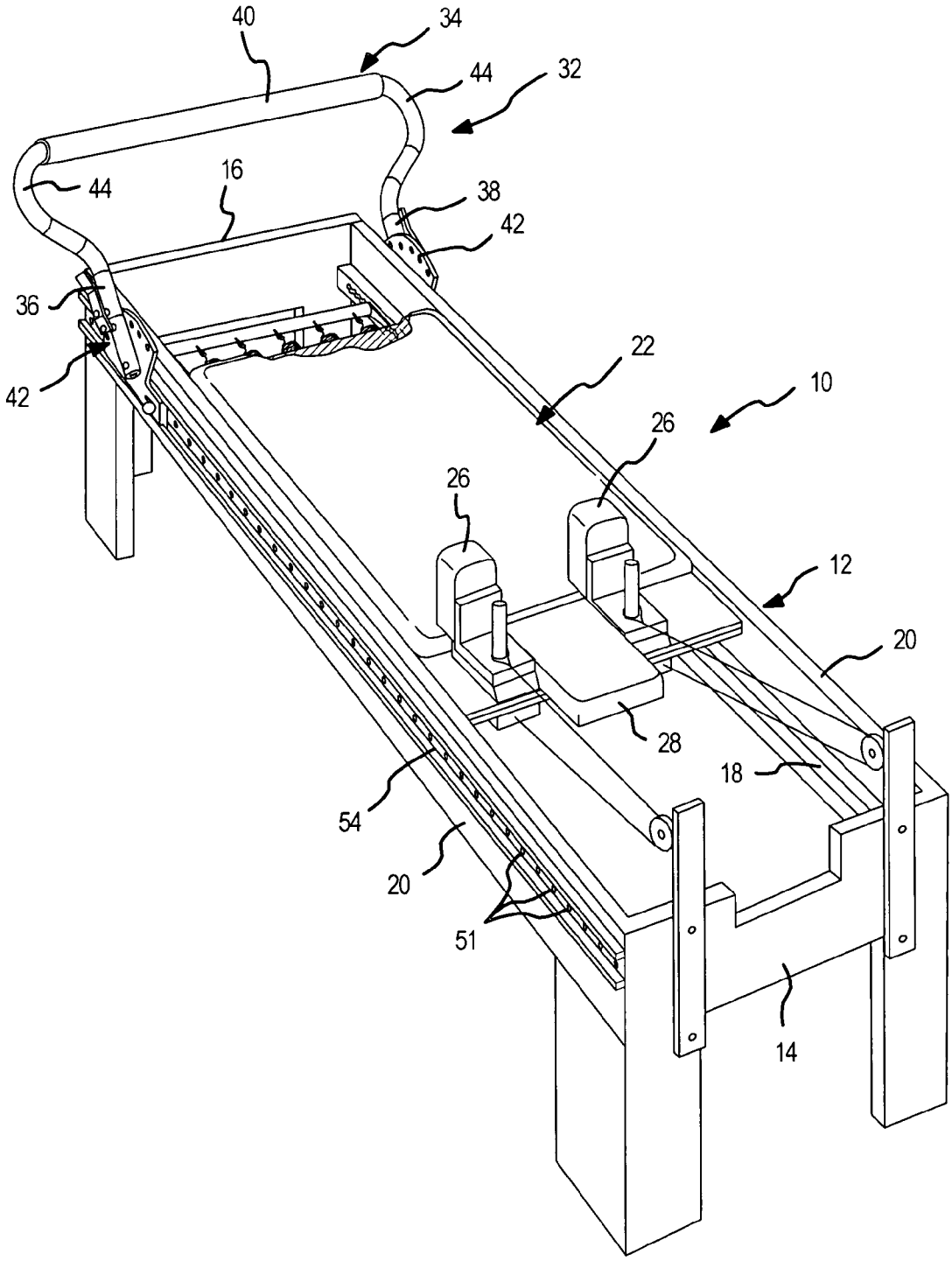
FIG. 1 is a perspective view of a reformer exercise apparatus in accordance with embodiments of the present invention with portions of the carriage in the retracted position against the carriage stops of the anchor bar and carriage stop assembly.

An exercise apparatus 10 in accordance with one embodiment of the present invention is shown in FIG. 1. Exercise apparatus 10 comprises a generally rectangular frame 12 having a head end 14 and a foot end 16 and a pair of parallel track members 18. The frame 12 may be a generally rectangular wood frame with the track members 18 fastened to the insides of opposite side walls 20 of the frame 12, or the track members 18 themselves may constitute the parallel side walls of the frame 12, as in a reformer having a metal tubular frame. The apparatus 10 further comprises a movable carriage 22 slidably or rollably disposed on the track members 18 for movement back and forth on the track members 18 between the head and foot ends 14 and 16 respectively.

Each of the track members 18 in the reformer apparatus 10 in accordance with the present invention is a metal tube that has a rectangular, and preferably a generally square cross-sectional shape. These metal tubes are, in the embodiment illustrated, bolted or otherwise fastened to the inside surfaces of the side walls 20 of the frame 12.

The carriage 22 includes a generally flat padded platform 24 for supporting a user's body and has a pair of spaced apart shoulder stops 26 fastened to the upper surface of the platform 24 adjacent the head end of the carriage 22 and a head rest 28 centered between the shoulder stops 26. The head rest 28 may be hinged to the platform 24 such that it may be adjusted between at least a raised and a lowered position. The head rest extends outward from the platform 24 toward the head end of the frame 12. Preferably the carriage 22 has four support wheels or rollers (not shown) which support the carriage 22 on the horizontal top surface of the track members 18 for movement back and forth on the track members 18 with minimal friction. The carriage 22 also has 4 guide rollers 25 (FIG. 5) beneath the platform 24 adjacent the support rollers that roll along the vertical surface of the track members 18 to prevent binding of the carriage 22 on the track members 18 or against the frame side walls 20. The guide and support rollers are mounted to a square tubular member 27 fastened to the underside of the platform 24. A plurality of elastic resistance members 30, typically springs as shown in the Figures, are hooked to or otherwise fastened between the foot end of the carriage 22 and the foot end 14 of the frame 12 such that the carriage 22 is biased toward the foot end of the frame 12.

The foot bar assembly 32 comprises a generally U shaped foot bar 34, preferably made of tubular aluminum, having a pair of spaced parallel leg portions 36 and 38 and a foot bar portion 40 therebetween and a pair of adjustable support bracket assemblies 42. A padded sleeve over the foot bar portion 40 provides a cushion support for a user's foot. The foot bar support bracket assembly 42 is separately shown in perspective separated from the frame 12 in FIG. 3.

Figure 3:
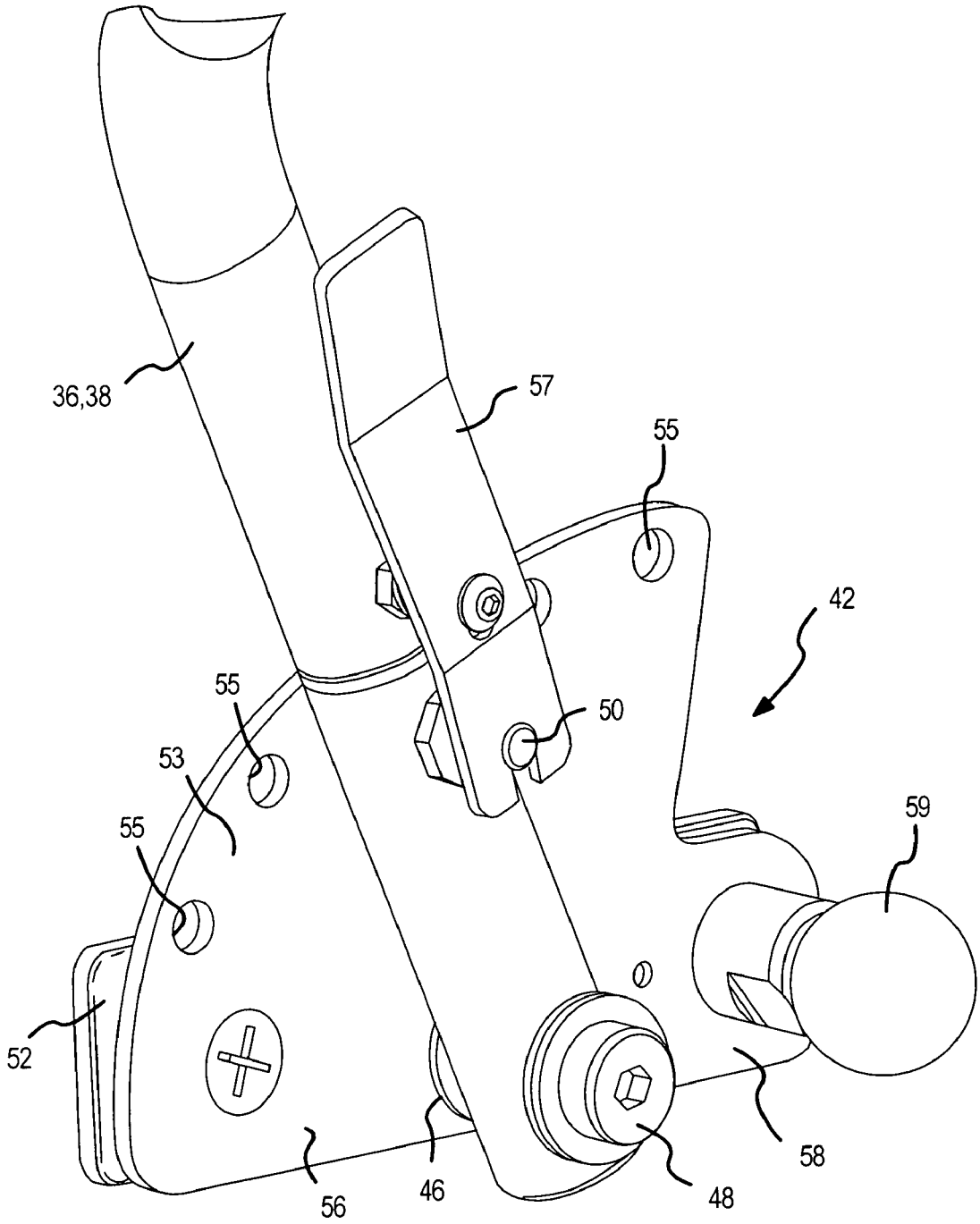
FIG. 3 is a separate perspective view of the foot bar support assembly shown in FIGS. 1 and 2.

The foot bar portion 40 has a generally S shaped recurve region 44 at each end thereof joining the leg portions 36 and 38 so that the straight portion of the foot bar portion 40 extends fully across the rail members 18 and, when the foot bar 34 is rotated so as to lie horizontally over the foot end 16, the bar 34 clears the end 16. The recurve region 44 further provides a more rigid structure to the foot bar 34 than a simple straight right angle bend between the leg and foot bar portions and provides clearance for a user's ankles when the users feet are spaced apart on the bar 34. Referring now to FIG. 3, at each distal end of the leg portions 36 and 38 is a transverse bearing sleeve 46. A pivot pin 48 is fastened through the sleeve 46 into a threaded central bore in one of the support brackets 42. A spring loaded stop pin 50 is fitted through a corresponding bore through each of the leg portions 36 and 38 spaced above the pivot sleeve 46. This stop pin 50 is used to adjust the vertical position of the foot bar portion 40 of the bar 34 as more fully described below.

Each of the support bracket assemblies 42 comprises an elongated support bar 52 having a generally T shaped cross section sized complementary to a T-slot 54 mounted along the length of the frame side wall 20 so that the support bar 52 can slide back and forth in the T-slot 54 between the foot end 16 and the head end 14. Fastened to the base of the T shaped cross section of the support bar 52 is a support plate 56 having an elongated base portion 58 extending along the base of the support bar 52 and an arcuate portion 53 extending parallel to the top of the support bar 52. This arcuate portion 53 has a series of holes 55 spaced at different angles from the horizontal plane through the central pivot pin 48. The holes 55 are positioned to receive the spring loaded stop pin 50 to lock the position of the foot bar 34 at a particular desired height above the rail members 18. At least one of the holes 55 is directly above the pivot pin 48 providing a vertical position of the foot bar 34. Another of the holes 55 is horizontally aligned with the central pivot pin 48 to completely collapse the foot bar 34 around the foot end 16 of the frame 12. The stop pin 50 is activated by depressing a lever 57 that pivots to lift the spring biased stop pin 50 out of one of the holes 55 to permit the foot bar 34 to be rotated to a desired position. This configuration permits the foot bar 34 to be positioned below the top of the reformer so that the entire upper surface of the reformer 10 may be utilized without the foot bar 34.

At the other end of the base portion 58 of the support plate 56 is a spring loaded stop pin assembly 59. The pin of the stop pin assembly 59 selectively fits into one of a plurality of horizontally spaced apart holes 51 in the T slot 54. The support bar 52 of the foot bar assembly 32 slides along in the T-slot 54. The spring loaded stop pin assembly 59 stops the support bar 52, and thus the foot bar assembly 32, at a desired position along the frame wall 20. This configuration, with the T slot 54 extending the entire length of the frame 12, facilitates a variety of new exercise possibilities that were heretofore impossible with a foot bar 34 positionable only adjacent a foot end of the frame of the reformer 10.

Figure 2:
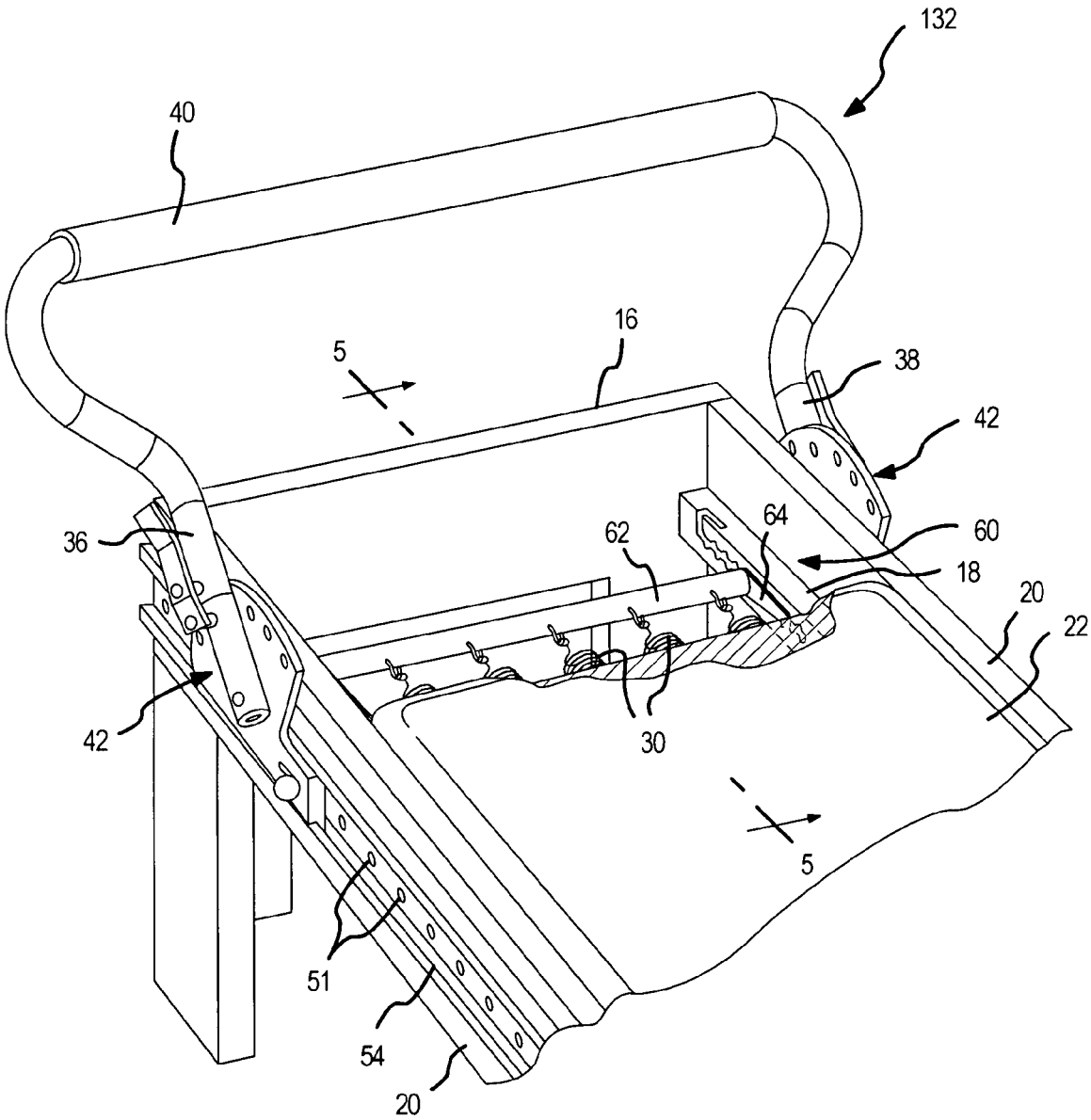
FIG. 2 is a partial enlarged perspective view of the foot end of the reformer shown in FIG. 1.

The reformer 10 incorporating embodiments of the present invention is shown in more detail in FIG. 2. The springs 30 are attached to an anchor bar and carriage stop assembly 60 incorporated with the tracks 18 at the foot end 16. The anchor bar and carriage stop assembly 60 adjustably anchors the springs 30 to an anchor bar 62 at the foot end 16 of the frame 12 and maintains a predetermined minimum distance between the carriage 22 and the anchor bar 62 via at least one carriage stop arm 64 attached to the anchor bar 62. The anchor bar 62 is an elongated straight bar or tube that may have a circular cross section. Alternatively, bar 62 may have a C shaped cross section or other elongated closed or open shape.

Figure 6:
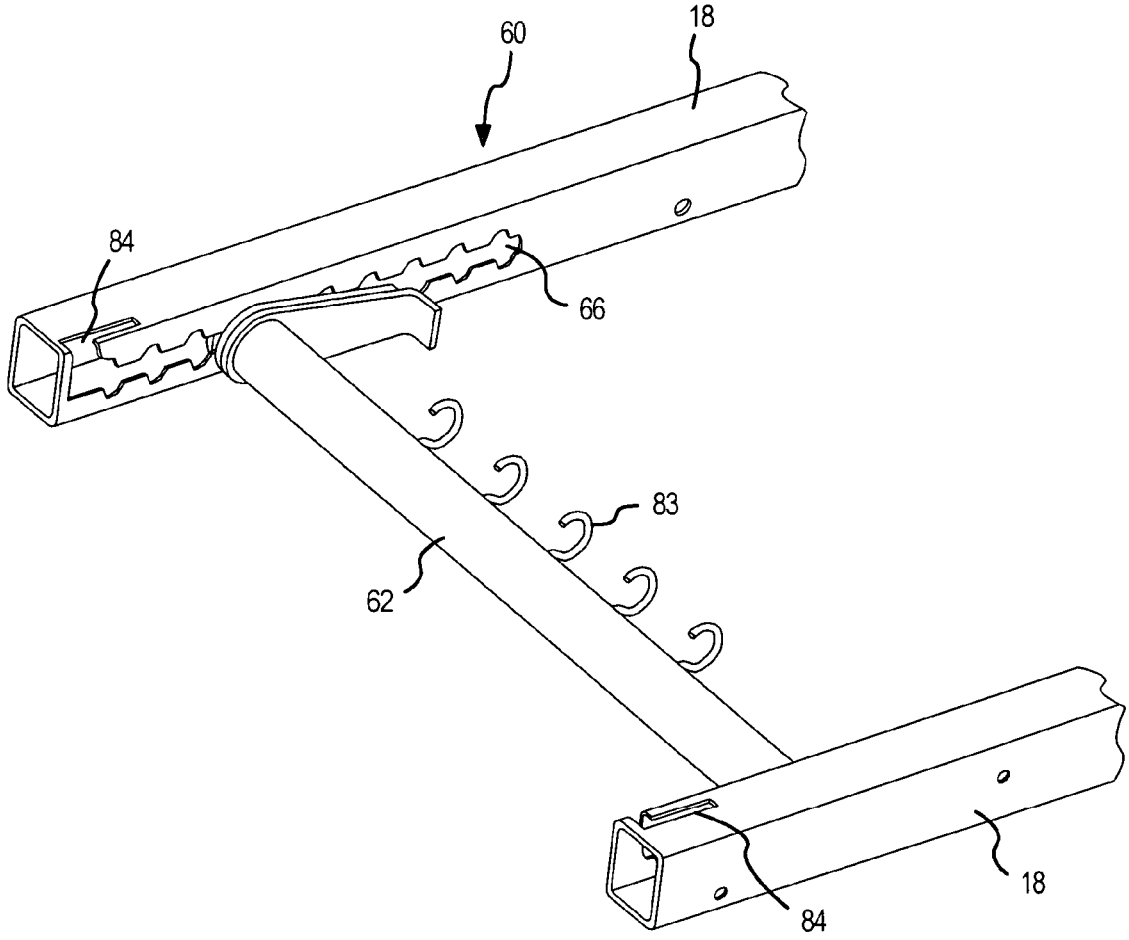
FIG. 6 is a separate perspective view of the anchor bar and carriage stop assembly in accordance with an embodiment of the present invention.
Figure 7:
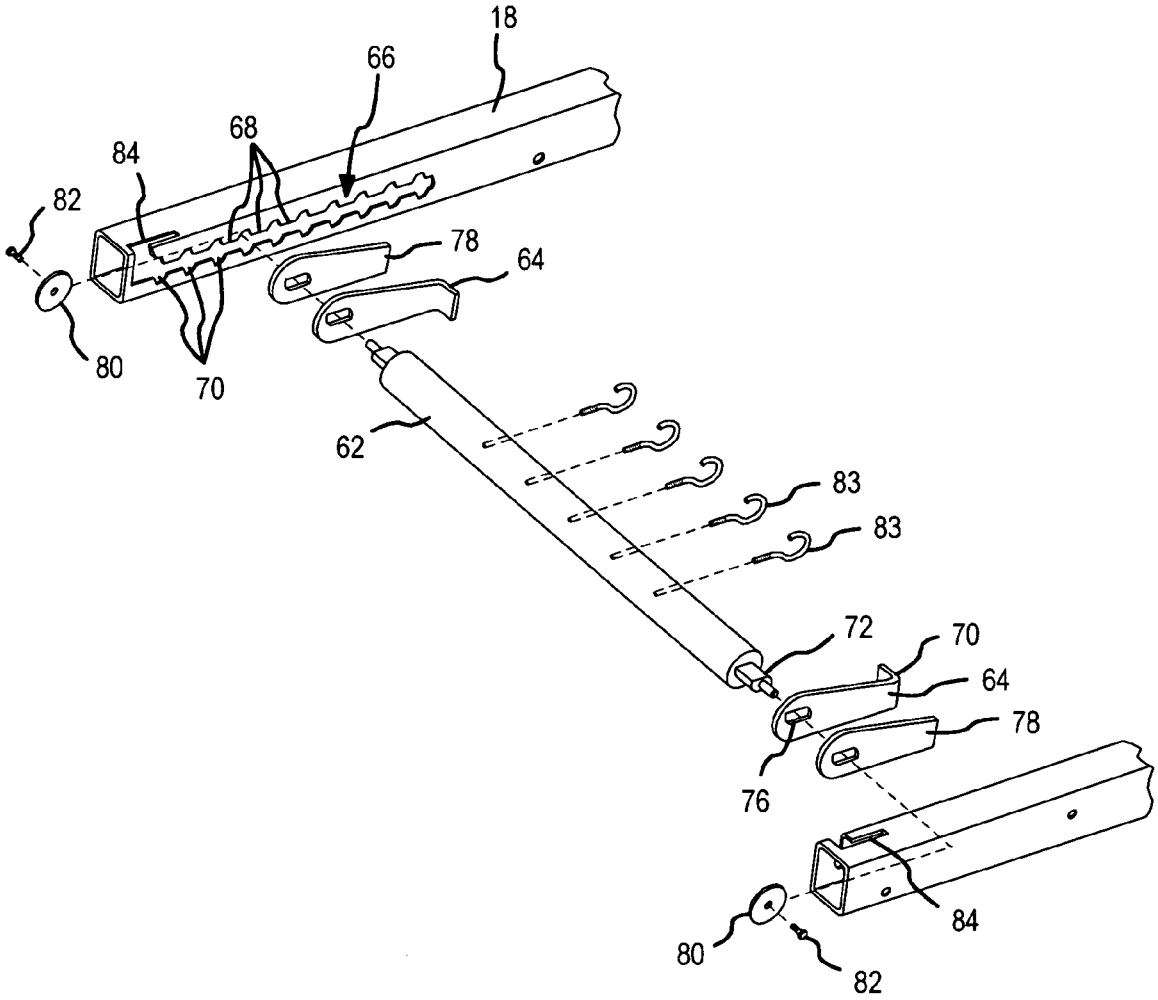
FIG. 7 is an exploded perspective view of the anchor bar and carriage stop assembly shown in FIG. 6.
Figure 8:
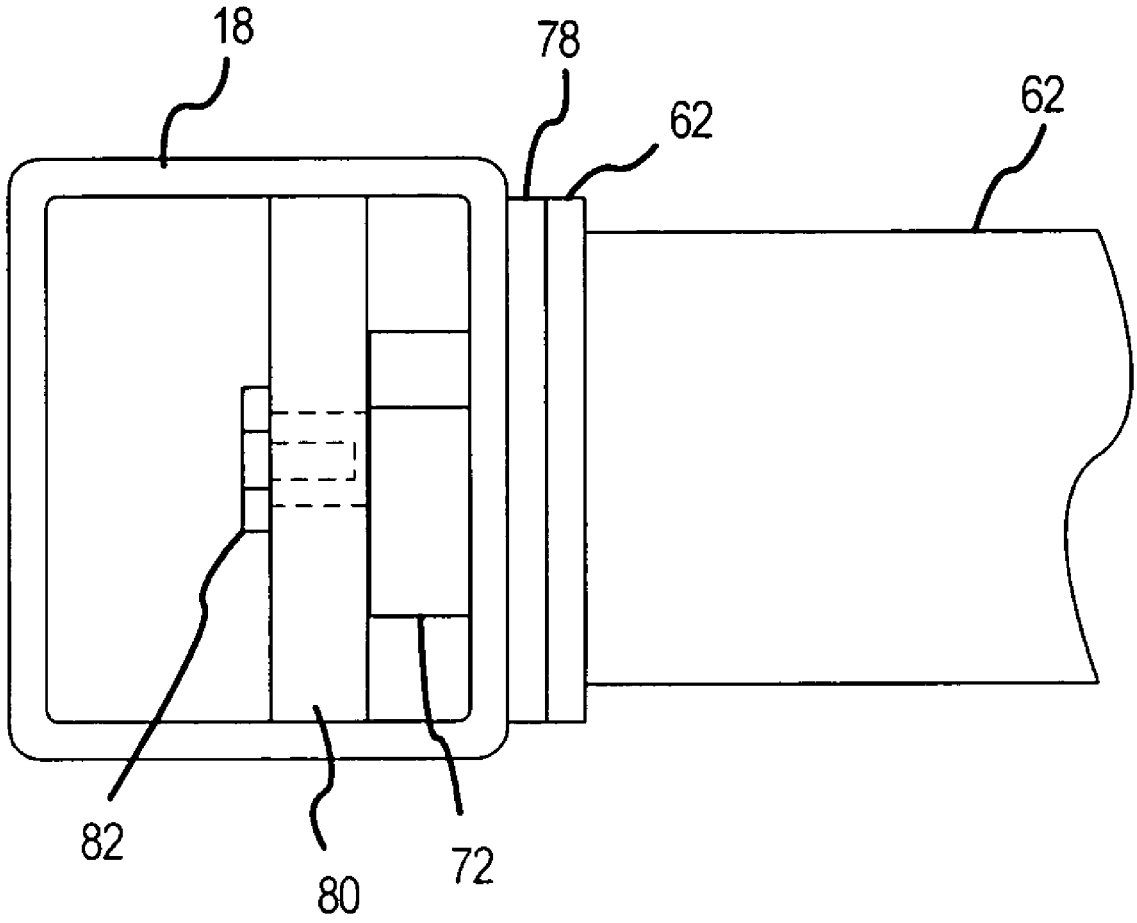
FIG. 8 is an end view of one side of the assembly shown in FIG. 6.

The anchor bar and carriage stop assembly 60 in accordance with an embodiment of the invention is separately shown in FIGS. 6, 7, and 8. The assembly 60 includes the pair of spaced track members 18 and the anchor bar 62. The anchor bar 62 has an elongated carriage stop arm 64 adjacent each end of the anchor bar 62. In the locked position, as will be explained in more detail below with reference to FIG. 4, the distal end of the stop arm 64 abuts against the carriage 22 to maintain a predetermined minimum distance between the anchor bar 62 and the carriage 22. This stop arm 64 also acts as a lever to rotate the anchor bar from the locked position to the unlocked position to permit the anchor bar 62 to be repositioned along the slot 66.

Each of the track members 18 has an elongated keyway slot 66 formed in the inside wall of the tubular track member 18 adjacent the foot end 16 of the frame 12. The portion of each track member 18 forming the keyway slot 66 includes a plurality of spaced gear teeth 68 defining anchor bar stop or lock portions 70. Each end of the anchor bar 62 includes a generally rectangular tenon 72 projecting axially as well as a projecting axle pin 74 extending from the distal end of the tenon 72. As is best seen in FIG. 7, the proximal end of the stop arm 64 has an elongated generally rectangular slot 76 complementary in shape to the tenon 72 to receive the tenon 72 therethrough such that the stop arm 64 is held against the base of the tenon 72 and cannot rotate about the anchor bar 62. An elongated spacer arm 78 similarly has a slot sized to fit the spacer onto the tenon 72. A guide wheel 80 is fastened onto the axle 74 with a screw 82.

As can be seen in FIG. 7, the stop arms 64 are assembled onto the tenons 72, the spacers installed next onto the tenons 72, and a guide wheel 80 is fastened to each of the axles 74. Finally, a series of spring anchor hooks 83 are installed onto the anchor bar. The wheels 80 of this subassembly are then dropped into the slots 84 in the top wall of the track members 18 that join with the slots 66 so that the tenons 72 on the anchor bar 62 fit into the slots 66 to complete the assembly of the anchor bar and carriage stop assembly 60. In this configuration, the guide wheels 80 ride between the top and bottom walls within the track members 18 to ensure that the tenons 72 are substantially centered in the slots 66 so that the anchor bar 62 will not bind in the track members 18 or slots 66. This can best be seen in the end view of FIG. 8.

Figure 4:
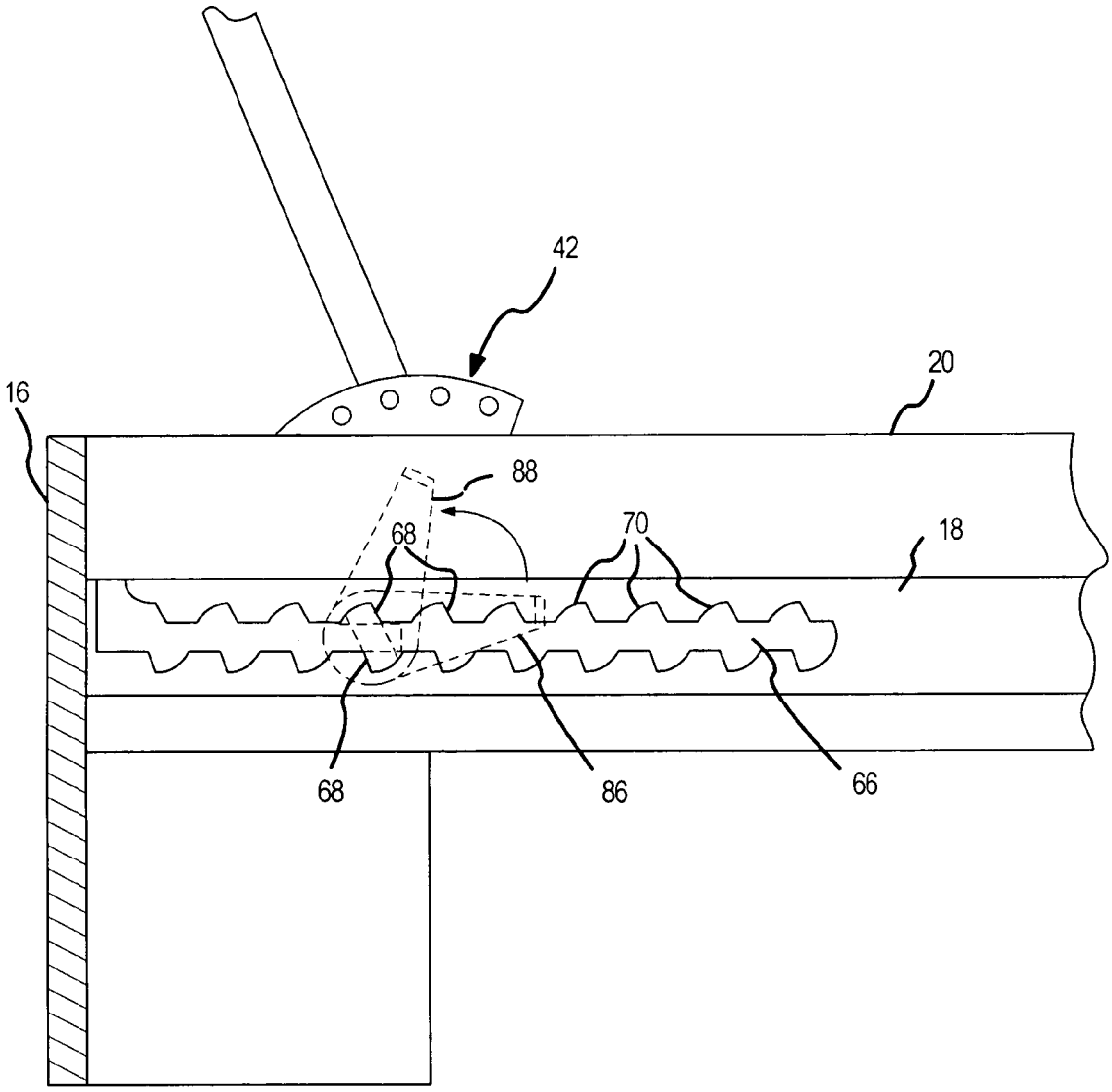
FIG. 4 is a partial view of the reformer from inside the foot end of the reformer shown in FIG. 1 with the right side of the frame removed illustrating the anchor bar in the locked position in dashed lines and in the unlocked position in dotted lines.
Figure 5:
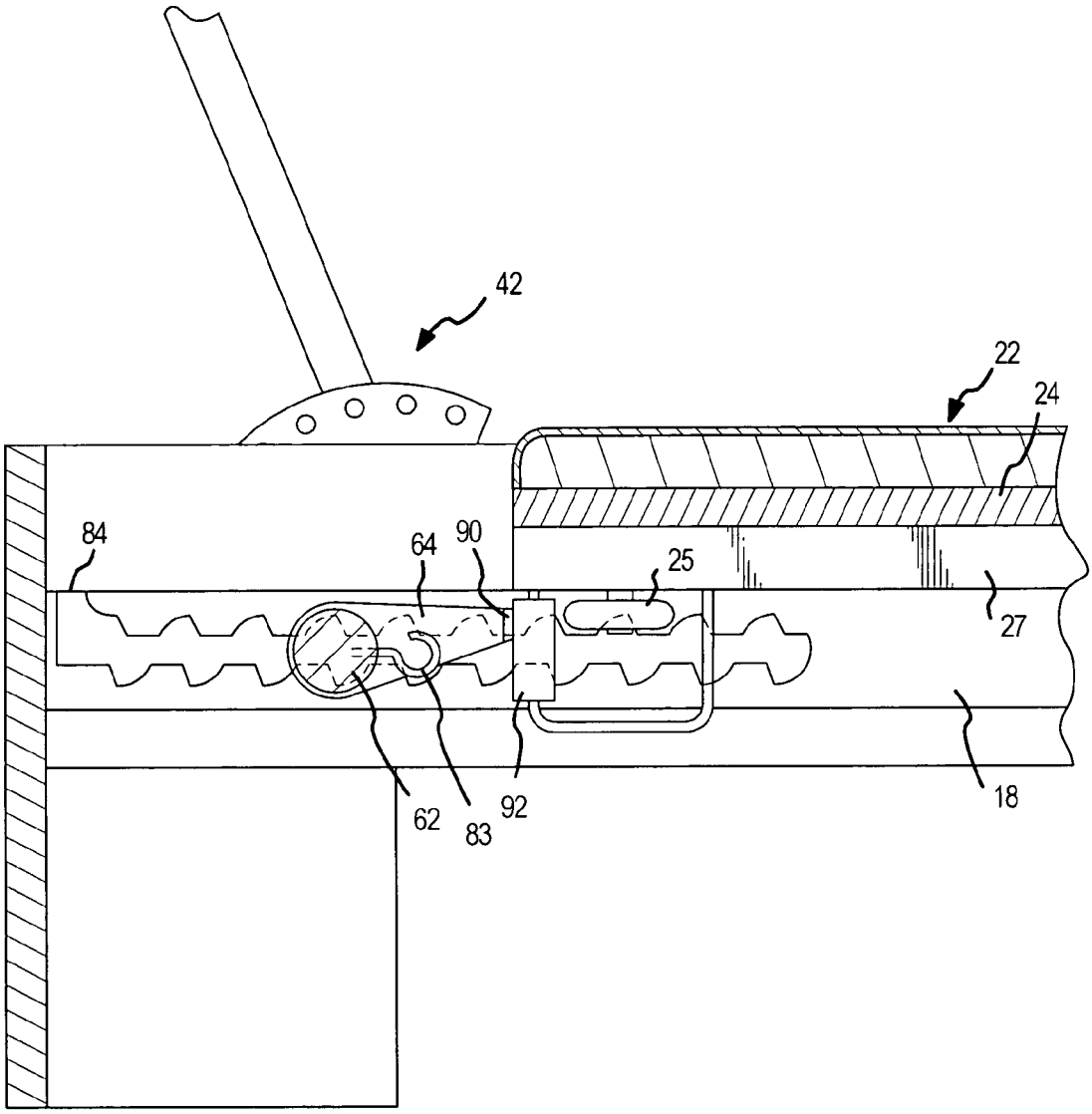
FIG. 5 is a sectional view taken along the line 5—5 in FIG. 2.

Operation of the assembly is best shown with reference to FIGS. 4 and 5. In FIG. 4, the foot end 16 of the apparatus 10 is shown with the anchor bar 62 positioned in both the locked position 86 and the unlocked position 88. The dashed lines 86 represent the anchor bar 62 in the locked position with the tenon 72 rotated so as to engage the teeth 68. In this position, note that the parallel sides of the tenon 72 are about 60 degrees from horizontal, thus preventing horizontal movement of the anchor bar 62.

The dotted lines 88 represent the anchor bar 62 in the unlocked position, in which the parallel sides of the tenons 72 are parallel to the longitudinal axis of the slot 66. In this rotational position, the anchor bar 62 is free to be moved from one lock portion to another lock portion. When the particular desired position is reached, the user can rotate the lock arms 64 clockwise to lock the anchor bar 62 in position and permit the carriage stop end 90 of the stop arms 64 to abut against a bumper 92 on the carriage 22 as is shown in FIG. 5. In this position, when at least one spring 30 is attached to one of the hooks 83, the anchor bar 62 is positively locked in position. In addition, even if no springs are attached, the anchor bar 62 is prevented from rotating upward or counterclockwise the offset mass of the assembly due to the elongated stop arms 64 projecting at right angles to the axis of rotation of the anchor bar 62.

The present invention may be practiced otherwise than as specifically described above. Many changes, alternatives, variations, and equivalents to the various structures shown and described will be apparent to one skilled in the art. For example, each of the track members could have a "top hat" or U shaped cross section such that, when fastened to the inside of the sides of the frame, the track has a horizontal track surface for the carriage support rollers and a vertical side wall for the carriage guide rollers to ride against. The anchor bar and carriage stop assembly may be designed for use in a reformer apparatus as is disclosed in U.S. Pat. Nos. 5,607,381 and 5,338,278. In this instance, the tracks form tubular frame rails and the anchor bar slots would simply be formed in the tubular frame rails. The foot bar support assembly 42 would be mounted in T slots 54 fastened to the outside wall of the tubular frame rails so that the foot bar assembly 32 may be positioned anywhere along the length of the frame rails. The anchor bar 62 may have a cross sectional shape other than circular as shown and may be solid or hollow. The stop arms 64 may have different shapes than a flat sheet metal shape as shown. These members may be round and may be alternately fashioned from a single piece of material. Similarly, the foot rest 32 and the foot rest support 38 may be made other than as specifically shown and described. The wheel 80 may be replaced with a sliding block arrangement in the tubular track member 18. Any such arrangement to keep the anchor bar tenon essentially centered in the slot 66 may be used. The anchor hooks 83 may be devices such as cap posts, hooks, rings, or other appropriately shaped members designed to receive or attach to one end of each of the springs 30. Alternatively, the anchor devices may be machined into the anchor bar 62.

Various other types of elastic resistance elements such as elastic cords may be substituted for springs 30. The carriage 22 may ride in a pair of horizontally oriented "U" shaped channel tracks, with the slots 66 and 54 integrally formed in the bottom wall portion of the extrusion of the track itself. A still further variation may include a pair of track members that each have an upper vertical wall, a middle horizontal wall, and a lower vertical wall, similar to a horizontally oriented "Z" shape cross-section with the keyway slots 66 formed in the lower wall. In this case, the carriage would roll along the middle wall and the upper wall would be fastened to the frame 12 of the reformer apparatus 10. Accordingly, the invention may be practiced other than as specifically described and shown herein with reference to the illustrated embodiments. The present invention is not intended to be limited to the particular embodiments illustrated but is intended to cover all such alternatives, modifications, and equivalents as may be included within the spirit and broad scope of the invention as defined by the following claims. All patents, patent applications, and printed publications referred to herein are hereby incorporated by reference in their entirety.

What is claimed is:

1. An exercise apparatus comprising:

a generally rectangular frame having a head end and a foot end and including a pair of spaced apart parallel track members between the ends, wherein each track member is a tubular extrusion having a rectangular cross section;

a movable carriage mounted on said frame for movement along said track members;

a plurality of elongated elastic members extending between said carriage and an anchor bar near said foot end of said frame;

an elastic member anchor bar and carriage stop assembly mounted to the track members adjustably anchoring said plurality of elastic members to the anchor bar held by the track members while maintaining a predetermined minimum distance between said carriage and said anchor bar, the anchor bar having opposite ends, each end including an axially extending tenon having two opposite sides, each track member including a longitudinally extending elongated slot sized to receive one of the tenons therein, each slot having spaced notches forming anchor bar stop portions defining spaced lock positions, wherein said opposite sides of said tenons engage the anchor bar stop portions of the slots in the locked positions, and a guide member attached to said anchor bar inside each said tubular track substantially centering said tenon in said slot.

2. An anchor bar and carriage stop assembly for use in a reformer apparatus having a movable carriage mounted on parallel track members, the assembly comprising:

each said track member having an elongated tubular shape and a longitudinal axis, each track member having an elongated slot through a wall of the tubular shape and extending parallel to the longitudinal axis of said track member; and an anchor bar having opposite ends, each end extending into the elongated slot in one of the track members, wherein each said elongated slot has a plurality of spaced notches forming anchor bar stop portions engaging the end of the bar to prevent movement along the slot when the anchor bar is in a locked position in one of the notches and a wheel attached to each end of the anchor bar in the tubular track member to center the end in the slot.

3. An exercise apparatus comprising:

a generally rectangular frame having a head end and a foot end and including a pair of spaced apart parallel track members between the ends;

a movable carriage mounted on said frame for movement along said track members;

a plurality of elongated elastic members extending between said carriage and said foot end of said frame;

an elastic member anchor bar and carriage stop assembly mounted to the track members having an anchor bar supported within the track members adjustably anchoring said plurality of elastic members to the anchor bar; and a guide means in the track member for preventing binding of the anchor bar in the track member.

4. The apparatus according to claim 3 wherein the guide means is a wheel fastened to a portion of the anchor bar within the track member.

5. An anchor bar and carriage stop assembly for use in a reformer apparatus having a movable carriage mounted on parallel track members, the assembly comprising:

each said track member having an elongated hollow tubular shape and a longitudinal axis, each track member having an elongated slot through a wall of the hollow tubular shape, the elongated slot extending parallel to the longitudinal axis of said track member; and an anchor bar having opposite ends, each end extending through the elongated slot in the wall of one of the track members, wherein each said elongated slot has a plurality of spaced notches forming anchor bar stop portions engaging the end of the bar to prevent movement along the slot when the anchor bar is in a locked position in one of the notches and a wheel inside each tubular track member attached to the end of the anchor bar in the tubular track member to center the end in the slot.

6. An exercise apparatus comprising:

a generally rectangular frame having a head end and a foot end and including a pair of spaced apart parallel hollow rectangular tubular track members between the ends;

a movable carriage mounted on said frame for movement along said track members;

a plurality of elongated elastic members extending between said carriage and said foot end of said frame;

an elastic member anchor bar and carriage stop assembly mounted to the track members having an anchor bar supported within a closed slot in each of the hollow tubular track members adjustably anchoring said plurality of elastic members to the anchor bar at selected distances from the foot end of the frame; and a guide means in each of the track members for centering and preventing binding of the anchor bar in the track member.

* * * * *